United States Patent [19]

Scott et al.

[11] Patent Number: 4,600,108

[45] Date of Patent: Jul. 15, 1986

[54] WOOD STACKING DEVICE AND METHOD OF STACKING WOOD

[76] Inventors: Gary C. Scott, P.O. Box 638; Arthur W. Gibson, P.O. Box 636, both of Fall River Mills, Calif. 96028

[21] Appl. No.: 631,216

[22] Filed: Jul. 16, 1984

[51] Int. Cl.[4] ..... A47F 7/00

[52] U.S. Cl. ..... 211/49.1; 211/59.4; 211/60.1; 29/428

[58] Field of Search ..... 211/49.1, 59.4, 60.1; 29/428; 108/55.1, 56.1

[56] References Cited

U.S. PATENT DOCUMENTS

| | | | |
|---|---|---|---|
| 253,461 | 2/1882 | Wold | 211/49.1 X |
| 2,852,143 | 9/1958 | Taber | 211/59.4 |
| 2,917,180 | 12/1959 | Snyder | 211/59.4 |
| 3,099,354 | 7/1963 | O'Day | 211/59.4 |
| 3,187,901 | 6/1965 | Wilson | 211/60.1 |
| 3,861,695 | 1/1975 | Shourek et al. . | |

*Primary Examiner*—Robert W. Gibson, Jr.
*Assistant Examiner*—Blair Johnson
*Attorney, Agent, or Firm*—Leonard D. Schappert

[57] ABSTRACT

A portable device designed to aid in stacking wood, retaining the shape of a wood pile, and accurately quantifying the wood in the pile. The device is extremely easy to set up and dismantle, and it greatly facilitates the operations of stacking and quantifying wood.

1 Claim, 4 Drawing Figures

WOOD STACKING DEVICE AND METHOD OF STACKING WOOD

BACKGROUND OF THE INVENTION

1. Field of the Invention

This invention relates generally to devices designed to aid in stacking wood and retaining the shape of a wood pile, and more specifically to portable devices designed to be set up at a moment's notice, and usable to set and maintain square corners on a wood pile so that the wood in the pile can be quantified accurately.

2. Description of the Prior Art

In the past, individuals have utilized stakes driven into the ground to establish the ends of a wood pile and for purposes of making an accurate determination as to the number of cords in a given wood pile. Others have directed their efforts to wood stacking aids which include some sort of frame with upright sections at each end and are designed to contain a pile of wood. Yet other individuals have stacked wood using ends which alternate the stacking of pieces of wood at right angles with respect to each other, thereby stabilizing the wood pile.

SUMMARY OF THE INVENTION

The present invention consists of a wood stacking device having a base which sits against the ground and an upright member hinged to the base so that, when the upright member is folded up from the base, the base and the upright member are at substantially a ninety-degree angle with respect to each other. In utilizing the wood stacking device, the operater stacks wood on the base and against the upright member, thereby establishing an end of the wood pile. As the wood pile is enlarged, a rope which is attached to the upright member is pulled out across the wood which is being stacked, and a piece of wood attached to the opposite end of the rope is stacked in the wood pile along with the wood. Additional wood is then stacked on top of the rope to aid in holding the upright member in an upright position.

One of the objects of the present invention is to provide a wood stacking device which aids in keeping the ends of a wood pile straight to facilitate accurate quantification of the wood in a given pile.

Another object of the present invention is to provide a wood stacking device which is stable.

Another object of the present invention is to provide a wood stacking device which is foldable and portable so that it may easily be stored in a small space when not in use.

A further object of the present invention is to provide a method of stacking wood which insures straight ends on the wood pile, thereby improving accuracy in quantifying the wood in the pile.

The foregoing objects, as well as other objects and benefits of the present invention, are made more apparent by the descriptions and claims which follow.

DESCRIPTION OF THE PREFERRED EMBODIMENT

Figure 1:
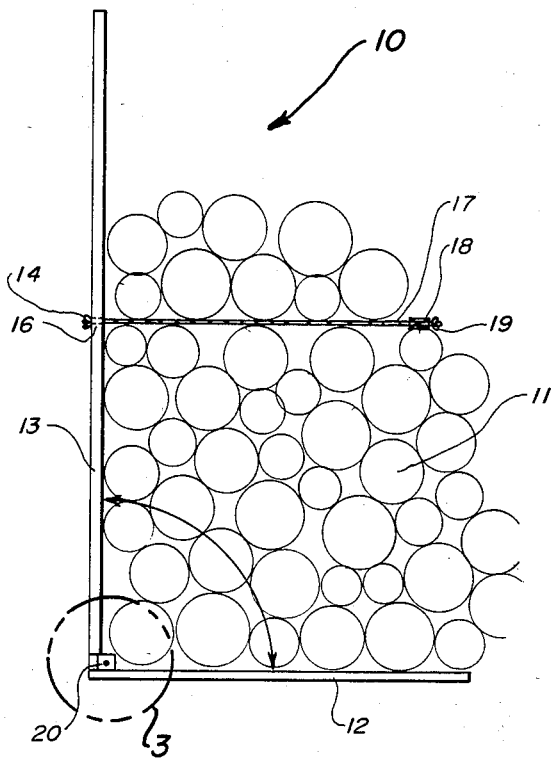
FIG. 1 is a side view showing the wood stacking device with wood stacked thereon.

FIGS. 1 through 4 of the drawings illustrate the construction and use of the wood stacking device 10. Specifically, FIG. 1 shows wood stacking device 10 in use in maintaining one end of a stack of wood 11. In the operation of stacking wood 11, wood stacking device 10 is first folded open so that base 12 and vertical member 13 are positioned at substantially a right angle to each other. Base 12 is then set on the ground, and wood 11 is stacked on base 12 and against vertical member 13 up to the level of hole 16 and rope 17. When wood 11 is stacked up to the level of hole 16 in vertical member 13, rope 17 is pulled out as shown in FIG. 1, and block 18, which is attached to rope 17 by knot 19, is positioned in line with wood 11, and more wood is stacked on top of rope 17 as shown. The position of rope 17 and the pressure of wood stacked on top of rope 17 help to hold vertical member 13 in an upright position after the wood 11 is stacked. Utilizing two wood stacking devices 10, an individual can stack a substantially rectangular stack of wood, thereby facilitating the quantification of the wood in the pile. Also shown in FIG. 1 is hinge 20, which is disclosed in greater detail in FIGS. 3 and 4 of the drawings.

Figure 2:
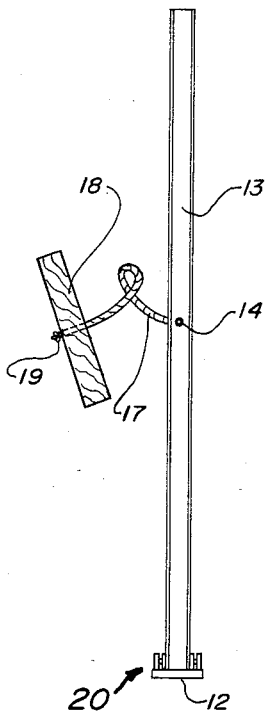
FIG. 2 is an end view of the wood stacking device set in an upright position, further showing its construction.

FIG. 2 of the drawings shows more clearly the construction of wood stacking device 10, and shows vertical member 13 from the back. Vertical member 13 is constructed generally in this embodiment of a U-beam, and base 12 is here constructed generally of a flat bar of metal. The attachment of rope 17 to block 18 through hole 16 and by knot 19 is also shown in greater detail.

Figure 3:
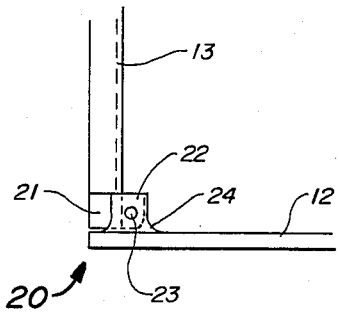
FIG. 3 is expanded side view showing the hinged area referred to as "3" in FIG. 1.
Figure 4:
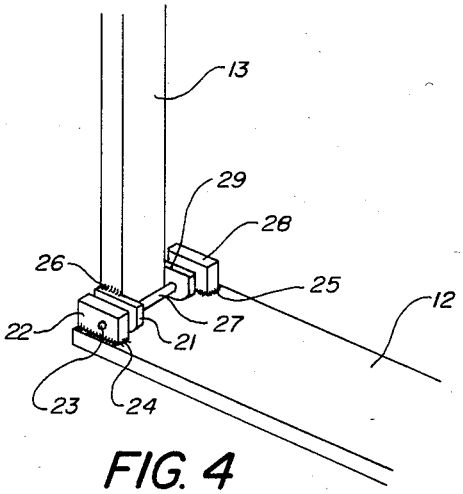
FIG. 4 is a perspective view showing the hinged area referred to as "3" in FIG. 1 and shown expanded in FIG. 3.

FIG. 3 is an expanded view of the encircled area designated "3" in FIG. 1, more specifically showing the construction of hinge 20. FIGS. 3 and 4, viewed together, disclose that the construction of hinge 20 includes blocks 21 and 29, which are attached to vertical member 13 by weld 26 and another weld not shown, and which are further attached to rod 27. Rod 27 extends into hole 23 in block 22 and a corresponding hole in block 28. Blocks 22 and 28 are attached to base 12 by welds 24 and 25. Vertical member 13 pivots with respect to base 12 on the hinge arrangement set forth above.

In practice, wood stacking device 10 can be folded along the line of the movement arrow shown in FIG. 1 so that vertical member 13 lies flat against base 12, and rope 17 can be wound around the combination of base 12 and vertical member 13 to fold them tightly together for purposes of storage. By utilizing two each wood stacking devices 10, an individual can easily establish the amount of wood required to constitute a cord.

While the foregoing description of the invention has shown a preferred embodiment using specific terms, such description is presented for illustrative purposes only. It is applicant's intention that changes and variations may be made without departure from the spirit or scope of the following claims, and this disclosure is not intended to limit applicant's protection in any way.

We claim:

1. A wood stacking device, comprising:

a base;

a vertical member pivotally attached to said base by pivot means whereby said vertical member folds against said base for storage, and a flexible rope having a first end and a second end, said first end being attached to said vertical member at a point substantially spaced from said pivot means and also from a free end of said vertical member for securing said vertical member tightly against said base when said wood stacking device is folded for storage and for holding said vertical member in a vertical position during stacking of wood on said base and against said vertical member when said rope is stretched over wood stacked on said base and more wood is stacked thereon, and having a rigid rod attached solely to said second end of said rope which is free to be positioned in said wood so that, when positioned in said wood, said rod helps to hold said rope in position, whereby a stack of wood stacked utilizing said wood stacking device retains a substantially vertical edge and is neater and easier to quantify.

* * * * *